United States Patent [19]

Nelson

[11] 4,420,028

[45] Dec. 13, 1983

[54] LUBRICATION SYSTEM FOR A DIE CASTING MACHINE

[75] Inventor: Edward M. Nelson, Greenfield, Wis.

[73] Assignee: Outboard Marine Corporation, Waukegan, Ill.

[21] Appl. No.: 201,982

[22] Filed: Oct. 29, 1980

[51] Int. Cl.[3] ..... B22D 17/20

[52] U.S. Cl. ..... 164/149; 164/158; 164/312; 425/107; 425/DIG. 115

[58] Field of Search ..... 164/149, 72, 158, 312; 425/107, DIG. 115

[56] References Cited

U.S. PATENT DOCUMENTS

| | | | |
|---|---|---|---|
| 2,717,433 | 9/1955 | McGervey, Jr. | 164/149 |
| 2,868,584 | 1/1959 | Faust | 299/86 |
| 3,029,752 | 4/1962 | Frank | 425/107 |
| 3,106,021 | 10/1963 | Borden | 32/28 |
| 3,595,342 | 7/1971 | O'Leary | 184/56 A |
| 3,613,772 | 10/1971 | Carr | 164/149 |
| 3,645,319 | 2/1972 | Pondelicek et al. | 164/72 |
| 3,767,012 | 10/1973 | Jimi et al. | 164/149 X |
| 3,920,099 | 11/1975 | Pondelicek et al. | 164/149 X |
| 3,941,211 | 3/1976 | Grutter et al. | 184/56 A |
| 3,982,609 | 9/1976 | Bouplon | 184/56 A |

FOREIGN PATENT DOCUMENTS

| | | | |
|---|---|---|---|
| 1227201 | 10/1966 | Fed. Rep. of Germany | 164/72 |
| 2526901 | 1/1977 | Fed. Rep. of Germany | 164/158 |
| 45-1048 | 1/1970 | Japan | 164/72 |
| 548368 | 3/1977 | U.S.S.R. | 164/149 |

*Primary Examiner*—Gus T. Hampilos
*Assistant Examiner*—J. Reed Batten, Jr.
*Attorney, Agent, or Firm*—Michael, Best & Friedrich

[57] ABSTRACT

A die casting machine comprises a die cavity, a sleeve communicating with the die cavity, and a piston which reciprocates within the sleeve to inject molten metal through the sleeve into the die cavity. The piston includes a stem portion having a passage which communicates with the interior of the sleeve. An air supply system is adapted to communicate with a source of pressurized air and with the stem portion passage to selectively deliver a stream of pressurized air into the sleeve through the stem portion passage. A lubricant supply system is adapted to communicate with a source of lubricant and is operatively connected with the air supply system for introducing lubricant into the air stream for delivery by the air stream into the sleeve. A cleaning fluid supply system is provided to selectively flush cleaning fluid through the lubricant and air supply systems and the stem portion passage.

4 Claims, 2 Drawing Figures

LUBRICATION SYSTEM FOR A DIE CASTING MACHINE

FIELD OF THE INVENTION

The invention generally relates to die casting machines. In particular, the invention relates to lubrication systems associated with die casting machines.

DESCRIPTION OF THE PRIOR ART

Attention is directed to the following United States Patents:

| | | |
|---|---|---|
| McGervey, Jr. | 2,717,433 | Sept. 13, 1955 |
| Faust | 2,868,584 | January 13, 1959 |
| Borden | 3,106,021 | October 8, 1963 |
| O'Leary | 3,595,342 | July 27, 1971 |
| Carr | 3,613,772 | October 19, 1971 |
| Pondelicek, et al | 3,920,099 | November 18, 1975 |
| Grutter, et al | 3,941,211 | March 2,1976 |
| Bouplon | 3,982,609 | Sept. 28, 1976 |

SUMMARY OF THE INVENTION

The invention provides a die casting machine having an associated lubrication system in which lubricant is introduced into a flowing stream of air for delivery by the stream of air into the interior portions of the machine.

More particularly, the invention provides a die casting machine comprising a die cavity, a sleeve which communicates with the die cavity, and a piston which reciprocates within the sleeve to inject molten metal into the die cavity. The piston includes a stem portion having a passage communicating with the interior of the sleeve. First means is provided which is adapted to communicate with a source of pressurized air and the stem portion passage and which is selectively operative for introducing a stream of pressurized air from the air source into the sleeve through the stem portion passage. Second means is also provided which is operatively connected with the first means and which is adapted to communicate with a source of lubricant for introducing lubricant from the lubricant source into the air stream for delivery by the air stream into the sleeve through the stem portion passage.

In one embodiment, the second means is operative to supply lubricant only when the first means is operative to carry a pressurized air stream.

In one embodiment, the first means includes air conduit means which is adapted to communicate with the pressurized air source and the stem portion passage for conducting the stream of pressurized air to the stem portion passage. The first means further includes control valve means operative between an inoperative position blocking the introduction of the stream of pressurized air by the air conduit means and an operative position permitting the introduction of the stream of pressurized air by the air conduit means. In this embodiment, the second means is operative only when the control valve means is in its operative position for introducing lubricant from the lubricant source into the stream of pressurized air.

In one embodiment, the second means includes means adapted to communicate with the pressurized air source and the lubricant source for pressurizing the lubricant source. The second means further includes lubricant conduit means communicating with the lubricant source and joining the air conduit means for conducting pressurized lubricant from its source into the air conduit means when the control valve means is in its operative position.

In one embodiment, the control valve means includes a first control valve in the air conduit means intermediate the source of pressurized air and the junction of the lubricant conduit means with the air conduit means and operative between an off position blocking the communication between the air source and the junction and an on position affording communication between the air source and the junction. The control valve means further includes a second control valve in the air conduit means intermediate the junction and the stem portion passage and operative between an off position blocking communication between the junction and the stem portion passage and an on position affording communication between the junction and the stem portion passage. In this embodiment, solenoid means operatively connects the first and second control valves for simultaneously moving the first and second control valves between their respective on positions and their respective off positions.

In one embodiment, third means is adapted to communicate with a source of cleaning fluid as well as with the first and second means. The third means is operative for selectively introducing cleaning fluid into the first means, the second means, and the stem portion passage to remove traces of lubricant which can block or restrict the delivery of lubricant into the sleeve.

One of the principal features of the invention is the provision of a die casting machine having a lubrication system for applying lubricant to the interior surfaces of the injection sleeve and which includes an air supply system which introduces a stream of pressurized air into the injection sleeve and a lubricant supply system which introduces lubricant into the flowing stream of air for delivery by the flowing stream of air into the sleeve.

Another of the principal features of the invention is the provision of a die casting machine which includes a lubricant supply system which is operative to supply lubricant into the injection sleeve solely during the presence of an air stream flowing through an associated air supply system.

A further principal feature of the invention is the provision of a die casting machine which includes a lubrication system and a cleaning system which communicates with the lubrication system for introducing cleaning fluid into the lubrication system to selectively flush traces of lubricant from the lubrication system.

Other features and advantages of the embodiments of the invention will become apparent on reviewing the following general description, the drawings, and the appended claims.

Figure 1:
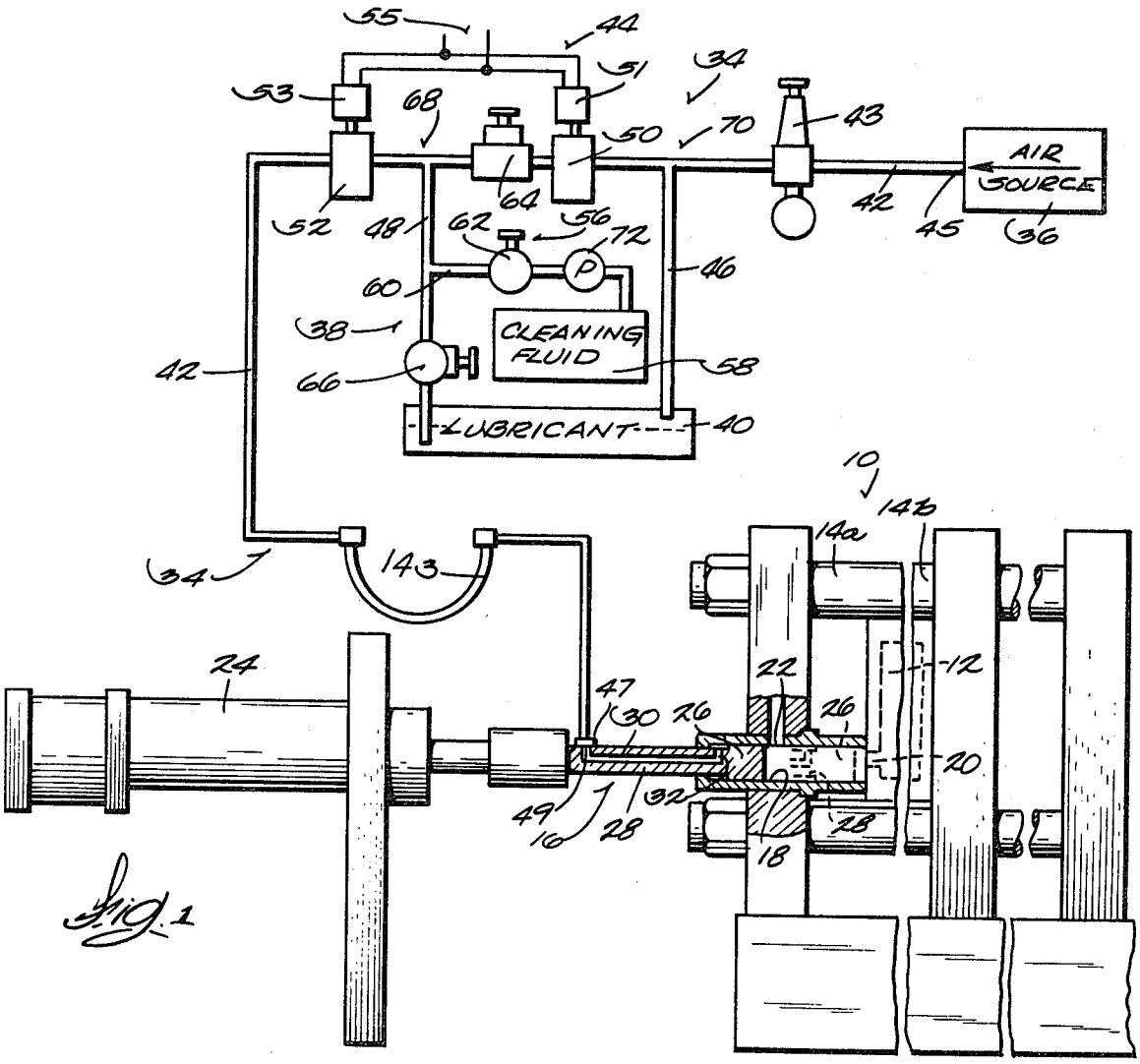
FIG. 1 is a partially diagrammatic view, with parts broken away and in section, of a die casting machine having a lubrication system which embodies various of the features of the invention.

Before explaining the embodiments of the invention in detail, it is to be understood that the invention is not limited in its application to the details of the construction and the arrangement of the components set forth in the following description or as illustrated in the drawings. The invention is capable of other embodiments and of being practiced or carried out in various ways. Also, it is to be understood that the phraseology and terminology employed herein are for the purpose of description and should not be regarded as limiting.

GENERAL DESCRIPTION

A die casting machine 10 is shown in FIG. 1. The machine 10 includes a pair of die members 14*a* and 14*b* which, when in an assembled relationship, together form a die cavity 12.

The machine 10 further includes a hydraulically actuated piston 16 which includes a head portion 26 and a stem portion 28. The piston 16 reciprocates within a cylinder or sleeve 18 which communicates with the die cavity 12 by means of injection inlet 20. When the piston head portion 26 is in a first, or retracted, position (as shown in solid lines in FIG. 1), molten metal can be introduced into the sleeve 18 through an opening 22. The piston head portion 26 can then be moved in the sleeve 18 by means of a hydraulic cylinder 24 toward a second, or extended, position (as shown in phantom lines in FIG. 1). Molten metal is thus injected under pressure into the die cavity 12.

As it is desirable to lubricate the interior surfaces of the sleeve 18 during die-casting operations, the piston stem portion 28 includes an interior bore or passage 30 which communicates with the interior of the sleeve 18 by means of an orifice 32 which, in the illustrated embodiment, is located closely adjacent to the piston head portion 26. As will be described in greater detail later herein, lubrication is accomplished in the illustrated embodiment by introducing lubricant into a flowing stream of pressurized air which is, in turn, introduced into the interior of the sleeve 18 through the passage 30 and orifice 32.

Figure 2:
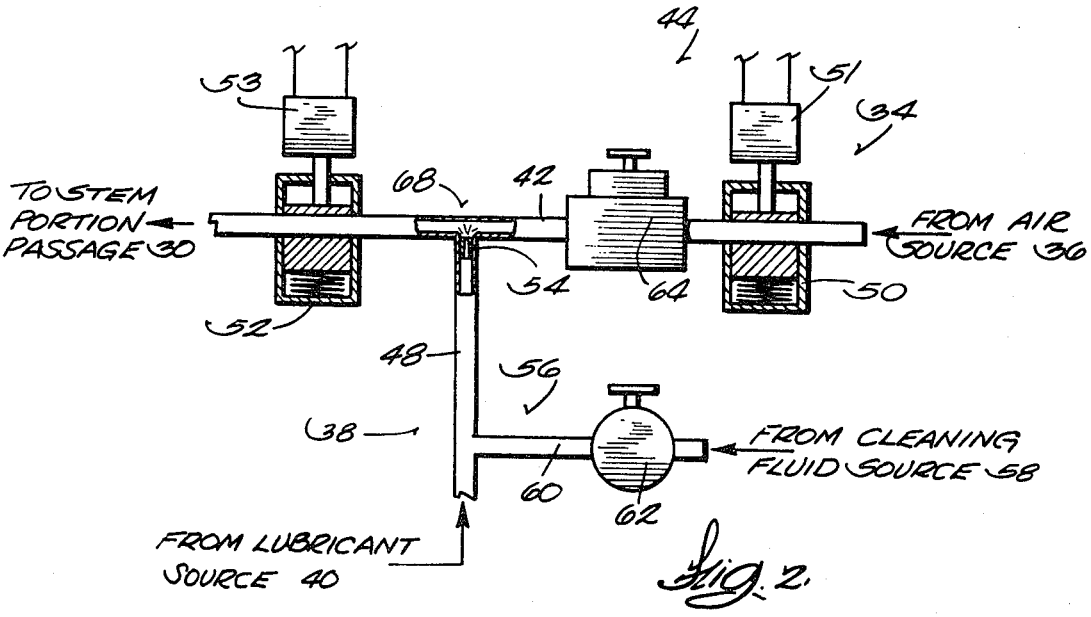
FIG. 2 is an enlarged partially diagrammatic view, with parts broken away and in section, of the lubrication system shown in FIG. 1.

Referring now to both FIGS. 1 and 2, to accomplish the above generally described lubrication, the machine 10 includes first means 34 which is adapted to communicate with a source of pressurized air 36 and the stem portion passage 30. The first means 34 is operative for selectively introducing a stream of pressurized air from the air source 36 into the sleeve 18 through the stem portion passage 30.

The machine 10 also includes second means 38 operatively connected with the first means 34 and adapted to communicate with a source of lubricant 40 for introducing lubricant from the lubricant source 40 into the air stream for delivery by the air stream into the sleeve 18 through the stem portion passage 30. By virtue of this arrangement, and as will be described in greater detail later herein, the second means 38 is operative to supply lubricant into interior portion of the sleeve 18 only during the presence of an air stream in the first means 34.

While various constructions are possible, in the illustrated embodiment, the first means 34 includes an air conduit 42 which, through appropriate fittings (not shown) at one end 45, communicates with the pressurized air source 36 and which, by appropriate fittings (also not shown) at its opposite end 47, communicates with an aperture 49 located in the outermost end of the stem portion passage 30. The air conduit 42 includes a flexible section 143, such as a rubber hose, to accommodate reciprocation of the piston 16. The air conduit 42 thus does not interfere with the die casting operations of the machine 10.

The first means 34 further includes control valve means 44 which is operative for selectively blocking and permitting the conduction of the stream of pressurized air by the air conduit 42. A conventional air pressure regulator 43 may be provided (as shown in FIG. 1) in line with the air conduit 42 upstream of the control valve means 44 to maintain an air stream of uniform air pressure.

In this construction, the second means 38 includes a second air conduit 46 adapted by suitable fittings (not shown) to communicate with the lubricant source 40 as well as with the air source 36 to thereby pressurize the lubricant source 40. As shown, the second air conduit 46 joins the first mentioned air conduit 42 downstream of the pressure regulator 43 and upstream of the control valve means 44. This junction is generally identified by the numeral 70. The second means 38 further includes a lubricant conduit 48 which communicates with the lubricant source 40 and joins the first air conduit 42 (the junction being generally identified by the numeral 68) for conducting the lubricant under pressure from the source 40 into the air conduit 42 subject to the operation of the control valve means 44.

Instead of utilizing pressurized air to pressurize the lubricant source 40 as shown in the drawings, a pump (not shown) could be utilized to pump lubricant from its source 40 through the lubricant conduit 48 subject to the operation of the control valve means 44.

In the illustrated embodiment, the control valve means 44 includes first and second control valves 50 and 52 connected in series with the air conduit 42. As is best shown in FIG. 1, the first control valve 50 is located upstream of the junction 68 of the lubricant conduit 48 with the air conduit 42 and downstream of the junction 70 of the air conduit 46 with the air conduit 42. The second control valve 52 is located downstream of the junction 68 and upstream of the stem portion passage 30.

While various constructions are possible, as is shown in FIG. 2, each of the control valves 50 and 52 is operative between a spring biased off position (not shown) which blocks the flow of air through the respective valve 50 or 52, and an on position (shown in solid lines in FIG. 2) which permits airflow through the respective valve 50 or 52. Means in the form of solenoids 51 and 53 are operatively connected with the first and second control valves 50 and 52 for moving the first and second control valves 50 and 52 against the biasing force from their respective off positions to their respective on positions. The solenoids 51 and 53 are electrically interconnected by a suitable control circuit 55 so that the control valves 50 and 52 are opened simultaneously.

The electrical control circuit 55 can be triggered manually by the machine operator, or can be triggered automatically by means of a signal generated during operation of the machine 10, for example, during the return of the piston head portion 26 from its extended position toward its retracted position.

By virtue of this construction, when both control valves 50 and 52 are commonly biased toward their off positions, the flow of pressurized air through the air conduit 42 is blocked. The pressurized flow of lubricant through conduit 48 is likewise prevented. However, when the solenoids 51 and 52 are manually or automatically actuated, thereby simultaneously placing both of the control valves 50 and 52 in their on positions, pressurized air flows through the air conduit 42. At the same time, lubricant flows under pressure through the lubricant conduit 48 and is introduced at junction 68 into the air stream for delivered by the air stream into the sleeve 18 through the stem portion passage 30.

To meter the flow of lubricant into the air stream, in the illustrated embodiment (See FIG. 2), the second means 38 includes an orifice 54 or the like in the lubricant conduit 48 at its junction 68 with the air conduit 42. Furthermore, a control valve 66 (See FIG. 1) is provided in the lubricant conduit 48. The control valve 66 is manually operative by conventional means between an open position permitting the flow of lubricant through the conduit 48, a closed position blocking the flow of lubricant through the conduit 48, and a range of positions between the open and closed positions to regulate the volume of lubricant flowing in the conduit 48.

Traces of lubricant can collect within the conduits 42 and 48, the passage 30, and the associated orifices 32 and 54, and thereby block or restrict the delivery of lubrication into the sleeve 18. Thus, the machine 10 includes third means 56 for selectively introducing cleaning fluid under pressure through the first and second means 34 and 38 and the stem portion passage 30.

In the illustrated embodiment, the third means 56 includes a conduit 60 which by suitable fittings (not shown) communicates with a pressurized source of cleaning fluid 58 and with the lubricant conduit 48. While various methods of conducting pressurized cleaning fluid through conduit 60 are possible, a conventional pump 72 is utilized in the illustrated embodiment (See FIG. 1).

To control the introduction of cleaning fluid, the third means 56 further includes a manually operable control valve 62 in the cleaning fluid conduit 60 which is operative by conventional means between an open and closed position to, respectively, permit and block the pressurized flow of cleaning fluid through conduit 60.

Prior to opening valve 62 to introduce cleaning fluid, the lubricant control valve 66 must be first placed in its closed position to terminate the flow of pressurized lubricant to the orifice 54 as well as to prevent any undesirable backflow of cleaning fluid into the lubricant source 40. Furthermore, realizing that in order to introduce cleaning fluid downstream of the junction 68 into the stem portion passage 30, the downstream control valve 52 must be placed in its opened position, which thereby simultaneously opens the upstream control valve 50, a third control valve 64 is located in the air conduit 42 intermediate the junction 68 and the upstream control valve 50. The third control valve 64 is manually operative by conventional means between an open and closed position. When in a closed position, the valve 64 blocks the air conduit 42 upstream of the junction 68 to prevent the flow of cleaning fluid toward control valve 50.

When cleaning operations are completed, and it is once again desired to deliver lubricant to the sleeve 18, control valve 62 must be closed and control valves 66 and 64 opened. The operation of the first and second means 34 and 38 can then proceed as heretofore described.

Various of the features of the invention are set forth in the following claims.

I claim:

1. A die casting machine comprising a die member defining a cavity; a sleeve communicating with said die cavity; piston means operative for reciprocative movement within said sleeve and including a stem portion having a passage communicating with the interior of said sleeve; first means for introducing a stream of pressurized air into said sleeve through said stem portion passage and including an air conduit adapted to communicate with a source of pressurized air, and communicating with said stem portion; second means for introducing lubricant into said air conduit for delivery by the air stream into said sleeve through said stem portion passage, and including a lubricant conduit adapted to communicate with a source of lubricant and operatively connected with said air conduit; control means in said air conduit for selectively controlling air and lubricant flow to said stem portion passage; and third means for selectively blocking the conduction of the air stream by said air conduit and the conduction of the lubricant by said lubricant conduit while introducing cleaning fluid into said lubricant conduit, into said air conduit, and into said stem portion passage, said third means including a cleaning fluid conduit adapted to communicate with a source of cleaning fluid, communicating with said air conduit and said lubricant conduit and including first valve means for selectively controlling cleaning fluid flow through said cleaning fluid conduit, second valve means in said lubricant conduit for selectively blocking said lubricant conduit, and third valve means in said air conduit for selectively blocking said air conduit.

2. A die casting machine according to claim 1 wherein said second means includes orifice means in said lubricant conduit at the junction of said lubricant conduit with said air conduit for injecting said pressurized lubricant into said air conduit.

3. A die casting machine according to claim 1 or 2 wherein said second valve in said lubricant conduit means is operative for regulating the volume of lubricant conducted by said lubricant conduit to said air conduit.

4. A die casting machine according to claim 1 wherein said control means in said air conduit includes a first control valve intermediate the source of pressurized air and the junction of said lubricant conduit with said air conduit and operative between an off position blocking communication between said air source and said junction and an on position affording communication between said air source and said junction, a second control valve in said air conduit intermediate said junction and said stem portion passage and operative between an off position blocking communication between said junction and said stem portion passage and an on position affording communication between said junction and said stem portion passage, and means operatively connected with said first and second control valves for simultaneously moving said first and second control valves between said respective on positions and said respective off positions.

* * * * *

UNITED STATES PATENT AND TRADEMARK OFFICE

CERTIFICATE OF CORRECTION

PATENT NO. : 4,420,028

DATED : December 13, 1983

INVENTOR(S) : Edward M. Nelson

It is certified that error appears in the above-identified patent and that said Letters Patent are hereby corrected as shown below:

Column 6, line 13, after "portion", insert -- passage --.

Signed and Sealed this

*Ninth* Day of *July 1985*

[SEAL]

*Attest:*

DONALD J. QUIGG

*Attesting Officer*

*Acting Commissioner of Patents and Trademarks*